United States Patent [19]

Tarumi et al.

[11] Patent Number: 4,755,849

[45] Date of Patent: Jul. 5, 1988

[54] FIXING DEVICE FOR AN IMAGE REPRODUCING APPARATUS

[75] Inventors: Noriyoshi Tarumi, Hachioji; Kiyoshi Kimura, Iruma; Kouichi Gunzi, Hachioji, all of Japan

[73] Assignee: Konishiroku Photo Industry Co., Ltd., Tokyo, Japan

[21] Appl. No.: 921,678

[22] Filed: Oct. 21, 1986

Related U.S. Application Data

[63] Continuation of Ser. No. 763,303, Aug. 5, 1985, abandoned, which is a continuation of Ser. No. 293,867, Aug. 18, 1981, abandoned.

[30] Foreign Application Priority Data

Aug. 25, 1980 [JP] Japan ..... 55-116691

[51] Int. Cl.[4] ..... G03G 15/20

[52] U.S. Cl. ..... 355/3 FU; 219/216; 219/469; 432/60

[58] Field of Search ..... 355/3 R, 3 FU, 3 TR, 355/3 TE, 14 FU; 219/216, 469, 470; 432/60, 228

[56] References Cited

U.S. PATENT DOCUMENTS

| | | | |
|---|---|---|---|
| 3,575,580 | 4/1971 | Anderson | 219/469 X |
| 3,685,896 | 8/1972 | Kaupp | 355/3 TR |
| 3,861,863 | 1/1975 | Kudsi | 219/216 X |
| 4,034,189 | 7/1977 | Sakamaki et al. | 219/469 X |
| 4,095,886 | 6/1978 | Koeleman et al. | 219/216 X |
| 4,195,927 | 4/1980 | Fotland et al. | 355/3 TE |
| 4,253,007 | 2/1981 | Dannatt | 219/470 X |
| 4,266,115 | 5/1981 | Dannatt | 219/469 X |
| 4,341,455 | 7/1982 | Fedder | 355/3 TR |

FOREIGN PATENT DOCUMENTS

| | | | |
|---|---|---|---|
| 54-130034 | 10/1979 | Japan | 355/3 FU |

*Primary Examiner*—Fred L. Braun

*Attorney, Agent, or Firm*—Bierman and Muserlian

[57] ABSTRACT

An image reproducing apparatus wherein a heat generating member is disposed in the proximity of a roller fixing device at the side of a charge receptor from which a transfer sheet is introduced to the fixing device. The roller fixing device is a heat roller fixer and the heat generating member is a plate-shaped heat generating member disposed at the lower side of conveying path for the transfer sheet.

10 Claims, 3 Drawing Sheets

FIXING DEVICE FOR AN IMAGE REPRODUCING APPARATUS

PRIOR APPLICATION

This application is a continuation of U.S. patent application Ser. No. 763,303 filed Aug. 5, 1985 which is a continuation of U.S. patent application Ser. No. 293,867 filed Aug. 18, 1981, both now abandoned.

BACKGROUND OF THE INVENTION

1. Field of the Invention

The present invention relates to an image reproducing apparatus capable of rapidly transferring and fixing toner image on a charge receptor to a transfer member.

2. Description of the Prior Art

Generally, the image reproducing process using an iamge reproducing apparatus has the steps of forming, on a charge receptor making use of a photoconductive member, an electrostatic latent image corresponding to the document image of the document by a corona charging and projection of light, and forming a visible image by developing the latent image by a developer mainly consisting of colored minute powders of a thermoplastic generally referred to as "toner".

The visible image on the charge receptor, i.e. the toner image, is transferred to a transfer member by an electric process such as corona discharge, bias roller or the like, or mechanical means such as pressing or heating.

The toner image thus transferred to the transfer member is fixed by an ordinary heating means to complete the image forming process.

As stated above, electric process is usable as one of the measures for transferring the toner image on the charge receptor to a transfer member or the like. This method, however, suffers only a low efficiency of transfer and tends to incur disturbance of transferred image particularly when the transfer is made in the atmosphere of high humidity. To avoid this problem, transfer method which does not rely upon the electric process has been developed, such as transferring technique employing pressing, as disclosed in Japanese Patent Application Laid-open to public inspection No. 78,559/1974, and U.S. Pat. No. 3,591,276 and so forth.

For instance, according to the description made in Japanese Patent Application Publication No. 41,679/1971, the toner image on a photosensitive member is held in an elastic and heat resistant intermediate blanket to permit a transfer without leaving any toner image on the photosensitive member thereby to achieve a high quality of transferred image.

In the transfer technique disclosed in the above-mentioned prior art, however, there are following disadvantages. Namely, since the transfer and fixing of the toner image from the intermediate image carrier to the transfer member are achieved simultaneously by the application of heat and pressure, a large heat input is required for the fixing, resulting impractically in an increased consumption of electric power. The large heat input also deteriorates the mechanical durability of the intermediate image carrier and roller used for the transfer and fixing.

The current demand for higher speed of image reproduction requires correspondingly increased speed of fixing. To cope with this demand, various attempts have been made. For instance, it has been attempted to increase the electric power input to raise the temperature of the heating roller. Alternatively, the heat source is incorporated in the pressure roller itself, or the pressure roller is heated by an external heat source. All of these attempts, however, have problems concerning the electric power consumption and cost.

The above-described problem concerning the requirement of higher fixing speed equally applies to the image reproducing apparatus of the type in which the toner image is directly transferred to the transfer member without using any intermediate image carrier.

SUMMARY OF THE INVENTION

Accordingly, an object of the invention is to provide an image reproducing apparatus capable of transferring the toner image on the charge receptor to the transfer member and fixing the image to the latter at a high speed without being accompanied by increased power consumption.

To this end, according to the invention, there is provided an image reproducing apparatus of the type in which a toner image on a charge receptor is transferred into pressure contact with a transfer sheet and is then fixed on the transfer sheet by a fixing means, wherein the improvement comprises a heat generating member disposed in the proximity of said fixing means at the side of said charge receptor from which said transfer sheet is introduced to said fixing means. Further, there is provided an image reproducing apparatus of the type in which a toner image on a charge receptor is transferred into pressure contact with an intermediate image carrier and is then transferred and fixed a toner image on said intermediate image carrier into pressure contact with a transfer sheet by pressing by means of a first roller provided in said intermediate image carrier and a second roller adapted to be pressed onto said first roller through the medium of said intermediate image carrier, wherein the improvement comprises a heat generating member disposed in the proximity of said rollers at the side of said rollers from which said transfer sheet is introduced to said rollers.

The above and other objects, as well as advantageous features of the invention will become clear from the following description of the preferred embodiments taken in conjunction with the accompanying drawings.

DESCRIPTION OF THE PREFERRED EMBODIMENTS

Figure 1:
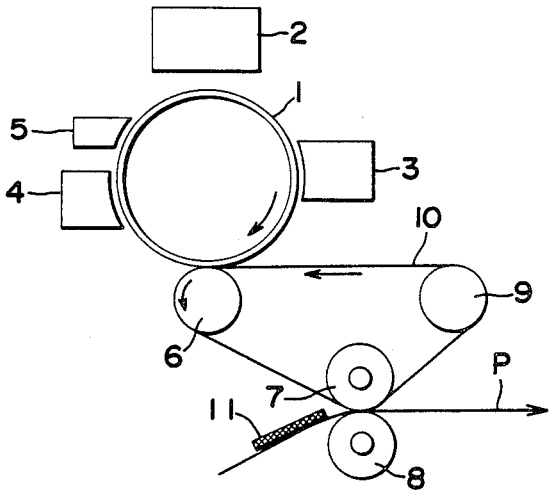
FIG. 1 is a schematic illustration of the whole part of an image reproducing apparatus of the invention.

Referring first to FIG. 1 schematically showing an image reproducing apparatus constructed in accordance with an embodiment of the invention, a reference numeral 1 denotes a charge receptor mounted on the drum surface, while a reference numeral 2 denotes an image forming section which is usually constituted by a corona generating device and an exposure device. A reference numeral 3 designates a developing section, while a reference numeral 4 denotes a cleaning section. An electric charge removing section is designated at a reference numeral 5. A reference numeral 6 denotes a pressure roller for transferring a toner image on the charge receptor 1 to an intermediate image carrier, 7 denotes a heat roller, 8 denotes a pressure roller, 9 denotes a driving roller, and 10 denotes a belt-shaped intermediate image carrier stretched around the rollers 6, 7 and 9.

The intermediate image carrier 10 has a double-layered structure consisting of an upper layer for carrying the toner image, and a lower layer underlying the upper layer. The upper layer is made of a heat resistant rubber such as silicone rubber, fluororubber and so forth, while the lower layer is made of a film of synthetic resin exhibiting a high heat resistance and small shrinkage, e.g. polyimide, polyamide, polyimideamide, polysulphone or the like, or a metallic film such as stainless steel, nickel or the like. An adhesive layer may be interposed between the upper and lower layers as required. The upper and lower layers of the belt-shaped intermediate image carrier have thicknesses ranging between 20 and 150μ, preferably 50 μ. The toner image on this intermediate image carrier 10 is transfered and fixed to a transfer member such as a transfer paper P, by the heat applied by the heat roller 7 and the pressure applied by the pressure roller 8.

A reference numeral 11 designates a plate-shaped heat generating member which may be a plate-shaped member provided with a plate-shaped heater, or a plate-shaped heater itself.

The plate-shaped heat generating member 11 has to be located at a position suitable for contacting the transfer paper P which is introduced into the pressure transfer and fixing system constituted by the heat roller 7 and the pressure roller 8 to suitably pre-heat the transfer paper P. In addition, since the plate-shaped heat generating member 11 serves also as a guide for the transfer paper P, it is preferably located at the feed-in side of the heat roller 7 and the pressure roller 8 in such a manner as to make a contact at its one end with the pressure roller 8. It is possible to further increase the transfer and fixing speed by providing the heat source in such a manner as to be able to heat also the pressure roller 8.

In the embodiment shown in FIG. 1, the plate-shaped heat generating member 11 is disposed above the transfer paper P to effectively heat the image carrying surface of the transfer paper P.

On the other hand, the toner remaining on the charge receptor 1 is removed by the cleaning section 4, while the residual charge on the charge receptor 1 is eliminated by the charge eliminating section 5 to regenerate the charge receptor 1 for the subsequent process.

Figure 2:
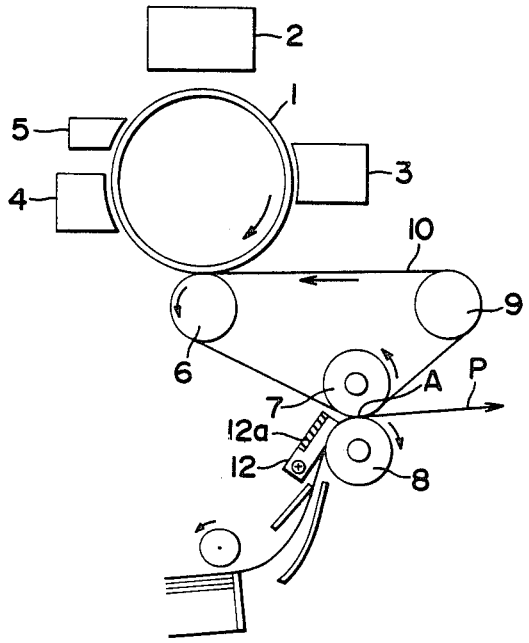
FIGS. 2 to 5 are schematic illustrations of image reproducing apparatus of different embodiments.

Referring now to FIG. 2 showing an image reproducing apparatus of another embodiment, reference numerals 1 to 10 and the symbol P denote the same parts or members as those of the first embodiment shown in FIG. 1. A reference numeral 12 denotes a plate-shaped heat generating member having an arcuate form to increase the area of contact with the pressure roller 8. The rate of generation of heat is so controlled as to provide a temperature of 150° to 180° C. at the contact region. In the illustrated embodiment, the heat generating member 12 is pressed against the pressure roller 8 by means of a spring 12*a*. This arrangement, however, is not exclusive and the heat generating member 12 may be pressed by the force of gravity without using any spring.

In this image reproducing apparatus, the surface of the pressure roller 8 is formed of a rubber material having a high resistance to heat and a low surface energy such as silicone rubber. The pressure roller 8 may or may not be provided with a heater. In the image reproducing apparatus shown in FIG. 2, a larger area of contact is preserved between the plate-shaped heat generating member and the transfer paper, to prolong the time length of contact to effectively heat the transfer paper.

In fact, the transfer paper can be heated sufficiently even when the surface temperature of the plate-shaped heat generating member is lowered down below 200° C., so that sufficient transfer and fixing effects are achieved without incurring any fixing failure, even when the transfer paper is conveyed at a high speed.

The friction coefficient between the plate-shaped heat generating member and the transfer paper is smaller than the friction coefficient between the transfer paper and the pressure roller, so that the transfer paper is moved as a unit with the outer peripheral surface of the pressure roller. In consequence, the leading end of the transfer paper is fed into the transfer and fixing section A as a unit with the pressure roller 8. As a result, the transfer paper is fed smoothly while avoiding the problem of formation of wrinkles in the transfer paper.

In order to avoid the offset phenomenon by toner attaching to the pressure roller from the latter to the plate-shaped heat generating member contacting the latter, the surface of the plate-shaped heat generating member contacting the pressure roller may be processed with Teflon (trade mark).

Figure 3:
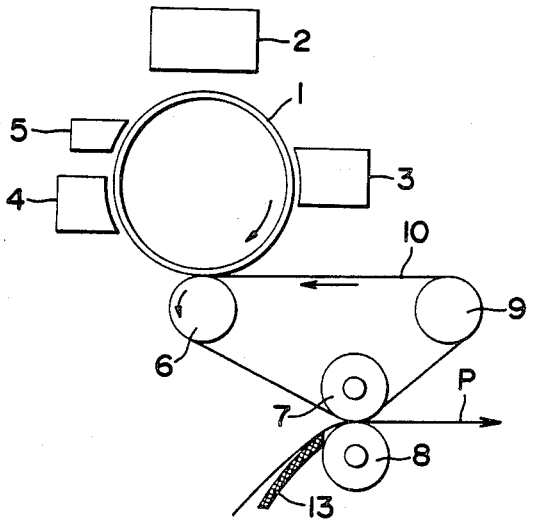

Referring now to FIG. 3 showing an image reproducing apparatus constructed in accordance with still another embodiment of the invention, a reference numeral 13 denotes a plate-shaped heat generating member located at the paper feed-in side of the heat roller 7 and the pressure roller 8, and is disposed at the lower side of conveying path for the transfer paper P, in such a manner as to make a contact at its one end with the pressure roller 8. Thus, the plate-shaped heat generating member 13 plays the double role of pre-heating of the transfer paper P and a guide for the transfer paper P when the latter is introduced into the transfer and fixing section.

Figure 4:
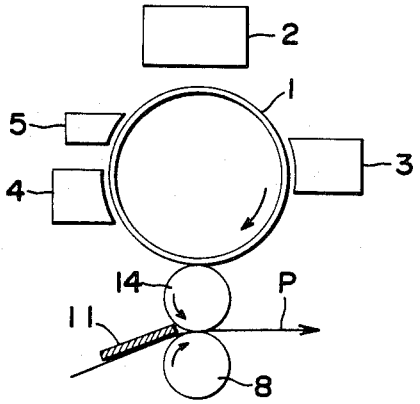

FIG. 4 schematically shows an image reproducing apparatus constructed in a further embodiment of the invention. In this embodiment, a drum-shaped intermediate image carrier 14 is used in place of the belt-shaped intermediate image carrier 10 used in the preceding embodiments described heretofore in connection with FIGS. 1 to 3. A heater is built-in in the drum-shaped intermediate image carrier 14. Other portions are materially identical to those of the preceding embodiments. It will be seen that the plate-shaped heat generating member can equally be used in accordance with the invention even when the apparatus has a drum-shaped intermediate image carrier.

Figure 5:
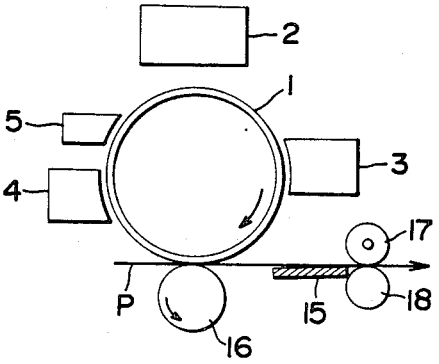
Figure 6A:
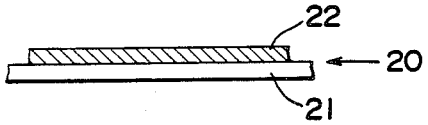
FIGS. 6(*a*), 6(*b*), 6(*c*), 6(*d*), 6(*e*) and 6(*f*) are outside views of a plate-shaped heat generating members, in which FIGS. 6(*a*), 6(*c*) and 6(*e*) are sectional views, FIGS. 6(*b*) and 6(*d*) are front elevational views and FIG. 6(*f*) shows a plate-shaped heat generating member having a convexed contact surface for contact with the pressure roller.
Figure 6B:
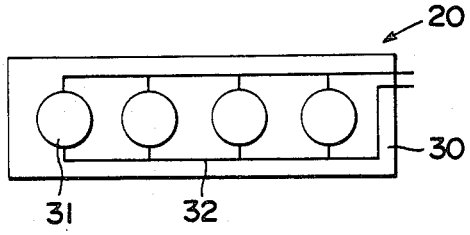
Figure 6C:
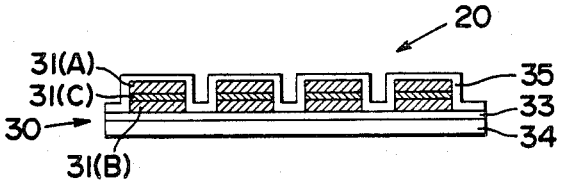
Figure 6D:
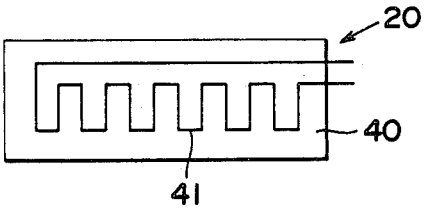
Figure 6E:
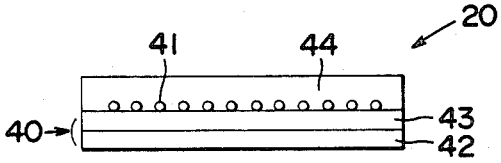
Figure 6F:
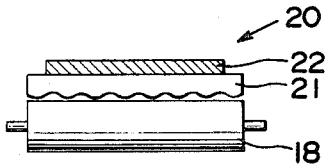

FIG. 5 schematically shows an image reproducing apparatus in accordance with a still further embodiment of the invention in which the intermediate image carrier used in the preceding embodiments is eliminated. Insteadly, in this embodiment, the toner image on the transfer paper P is transferred by using a bias roller 16, and the toner image on this transfer paper P is fixed by means of a heat-fixing roller.

In this Figure, a reference numeral 15 denotes a plate-shaped heat generating member, 17 denotes the heat-fixing roller and 18 denotes a pressure roller. This plate-shaped heat generating member 15 is effectively used also in the image reproducing apparatus having the transfer and fixing system of the type stated above. Namely, the conveyance of the transfer paper P is smoothed and the fixing speed is increased without causing any increase of the electric power consumed, thanks to the use of the transfer paper P.

FIGS. 6(*a*) to 6(*f*) show various forms of the plate-shaped heat generating member usable in the image reproducing apparatus of the invention.

More specifically, the plate-shaped heat generating member 20 shown in FIG. 6(*a*) has a plate-shaped base member 21 on which mounted is a plate-shaped heater 22. Any material having a good heat conductivity can be used as the material of the base member 21. Also, as will be mentioned later, known tabular heater such as Positive Temperature Coefficient (PTC) plate, wire heater, foil heater and so forth can be used as the plate-shaped heater 22.

FIG. 6(*b*) is a front elevational view of the plate-shaped heat generating member 20 incorporating the abovementioned PTC plate, while FIG. 6(*c*) is a schematic sectional view of the same.

Referring to FIG. 6(*b*), the plate-shaped heat generating member 20 has a plate-shaped base member 30 mounting a PTC assembly 31 interconnected by electric wires 32. Referring further to FIG. 6(*c*), the plate-shaped base member 30 has a plate 34 made of a material having a good heat conductivity such as aluminum on which applied is a heat-resistant insulating film 33. The PTC assembly 31 includes electrodes 31(A) and 31(B), and the PTC element 31(C) sandwiched therebetween. This PTC assembly is placed on the heat-resistant insulating film 33 and is coated with another layer of heat-resistant insulating film 35. The heat-resistant insulating film 35 is provided for preventing escape of the heat by conduction of heat, and can be made preferably from silicone resin film, fluoro resin film such as Teflon (trade mark), polyimide film, polyimideamide film or the like. The PTC element 31(C) preferably has a small thickness and should have a high heat generating efficiency. The shape of the PTC element may be circular or rectangular. PTC elements which can produce a surface temperature of about 150° C. are used most suitably.

FIG. 6(*d*) schematically shows another form of the plate-shaped heat generating member. In this Figure, a reference numeral 40 denotes a plate-shaped member, while a numeral 41 designates a wire heater. As will be seen from FIG. 6(*e*), the heater 41 is covered with heat-resistant insulating films 43 and 44. In this FIG. 6(*e*), a reference numeral 42 designates a plate-shaped base member having a high heat conductivity, to which bonded is a wire heater 41 sandwiched between heat-resistant insulating films 43 and 44 made of a material such as silicone resin, Teflon, polyimide, polyimideamide.

In still another form of the plate-shaped heat generating member 20 shown in FIG. 6(*f*), the side of the heat generating member 20 for contacting the pressure roller 18 is convexed in the direction of rotation of the pressure roller to reduce the frictional resistance between the plate-shaped base member 21 and the pressure roller 18.

Thus, the plate-shaped heat generating member can have any desired shape effective for achieving the object of the invention.

In the case where any supporting member is used to make the plate-shaped heat generating member contact with the transfer paper or the pressure roller, it is advisable to put a heat-resistant insulating film between, for example, the plate-shaped heat generating member and the supporting member, in order to avoid the loss of heat due to heat conduction.

As has been described, according to the invention, there is provided an image reproducing apparatus of the type in which a toner image on a charge receptor is transferred to a transfer paper directly or indirectly through the medium of an intermediate image carrier and then fixed to the transfer paper, wherein the improvement comprises a plate-shaped heat generating member disposed at the paper feed-in side of a pressure and heat fixing roller for transferring and fixing the toner image, the heat generating member being adapted to make contact with the transfer paper and to act also as a guide for the transfer paper when the latter is introduced into the transfer and fixing section.

In consequence, the conveyance of the transfer paper into the fixing section is smoothed and the paper is preheated so that it is possible to increase the speed of fixing without increasing the electric power consumption, while attaining a reduction of the size of the apparatus as a whole advantageously.

What is claimed is:

1. In an image reproducing apparatus wherein a toner image on a charge receptor is transferred into pressure contact with an intermediate image carrier to form an intermediate toner image and then said intermediate toner image comes into pressure contact with a transfer sheet to transfer said intermediate toner image and simultaneously fix it by pressing means, the improvement comprising a plate-shaped heat generating member facing and in proximity to said pressing means so that said transfer sheet is fed along the surface of said pressing means after being urged toward the pressing means by the heat generating member and is brought into contact with said intermediate image carrier, said heat generating member being disposed on the upper side of a conveying path for the transfer sheet, and said heat generating member being brought into contact with said pressing means.

2. The image reproducing apparatus of claim 1 wherein said plate-shaped heat generating member comprises a plate-shaped base member and a heater.

3. The image reproducing apparatus of claim 1, wherein said pressing means comprises a pressure roller and a second roller which is mounted to support said intermediate image carrier at a position opposite to said pressure roller.

4. The image reproducing apparatus of claim 1, wherein said intermediate image carrier is drum-shaped, and said pressing means is a pressure roller being in pressure contact with said intermediate image carrier.

5. The image reproducing apparatus of claim 1, wherein said intermediate image carrier is belt-shaped.

6. The image reproducing apparatus of claim 5, wherein said belt-shaped intermediate image carrier comprises a support and a rubber layer.

7. The image reproducing apparatus of claim 1, wherein a friction coefficient of a surface of said heat generating member facing said pressing means is smaller than that of said pressing means.

8. An image reproducing apparatus comprising a recording member for a toner image; an intermediate image carrier; a first transfer device for transferring the toner image from the member to the intermediate image carrier; a second transfer device for transferring the toner image from the intermediate image carrier to an image reception material, including a heating roller and a pressure roller which form therebetween a transfer gap, and a heating device for the image reception material, said heating device being arranged at the inlet side of the transfer gap; characterized in that said heating device is a heating plate arranged on the circumferential surface of the pressure roller of said second transfer device so that at least one portion of the heating plate is in pressure contact with the pressure roller; and that the image reception material is guided to the transfer gap between the pressure roller and the heating plate upon its entering the second transfer device.

9. The image reproducing apparatus of claim 8, wherein said intermediate image carrier is belt-shaped and is supported by support rollers, and said heating roller is one of said support rollers.

10. The image reproducing apparatus of claim 8, wherein a friction coefficient of a surface of said heating plate facing said pressure roller is smaller than that of said pressure roller.

* * * * *